US007993472B2

(12) United States Patent
Kim et al.

(10) Patent No.: US 7,993,472 B2
(45) Date of Patent: Aug. 9, 2011

(54) DISH WASHING MACHINE HAVING PUMP MOTOR AND PUMP MOTOR RECEIVING PART

(75) Inventors: Eui Soo Kim, Suweon-si (KR); Yong Woon Han, Gunpo-si (KR); Young Ho Kwon, Seognam-si (KR); Shimotera Kennichi, Seoul (KR); Sung Jin Kim, Suweon-si (KR); Jung Chan Ryu, Suwon-si (KR); Jae Young Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 951 days.

(21) Appl. No.: 11/806,520

(22) Filed: May 31, 2007

(65) Prior Publication Data

US 2008/0011340 A1 Jan. 17, 2008

(30) Foreign Application Priority Data

Jul. 12, 2006 (KR) ..... 10-2006-0065596

(51) Int. Cl.
*B08B 3/00* (2006.01)
*B08B 3/12* (2006.01)
*B08B 6/00* (2006.01)

(52) U.S. Cl. ..... 134/56 D; 134/57 D; 134/58 D; 134/105; 134/110; 134/111; 134/184; 134/186

(58) Field of Classification Search ..... 134/56 D, 134/57 D, 58 D, 105, 110, 111, 184, 186
See application file for complete search history.

(56) References Cited

U.S. PATENT DOCUMENTS

| | | | | |
|---|---|---|---|---|
| 5,143,306 | A * | 9/1992 | Nilsson | 241/46.012 |
| 5,651,382 | A * | 7/1997 | Sargeant et al. | 134/174 |
| 6,622,754 | B1 * | 9/2003 | Roth et al. | 134/18 |
| 2005/0133072 | A1 * | 6/2005 | Yoon et al. | 134/58 D |
| 2006/0054200 | A1 * | 3/2006 | Min et al. | 134/56 D |
| 2006/0118147 | A1 * | 6/2006 | Jeong et al. | 134/58 D |
| 2008/0072936 | A1 * | 3/2008 | Pyo et al. | 134/104.4 |

FOREIGN PATENT DOCUMENTS

| | | | |
|---|---|---|---|
| CN | 1628597 | | 6/2005 |
| DE | 3716954 | A * | 12/1988 |
| KR | 10-2005-0054700 | | 6/2005 |
| KR | 10-2006-0024597 | | 3/2006 |

OTHER PUBLICATIONS

DE 3716954 Machine Translation, date not applicable.*
DE 3716954 English Translation.*
Chinese Office Action for corresponding Chinese Reference 200710110060.9; issued Jan. 16, 2009.

* cited by examiner

*Primary Examiner* — Michael Barr
*Assistant Examiner* — Charles W Kling
(74) *Attorney, Agent, or Firm* — Staas & Halsey LLP

(57) ABSTRACT

A dish washing machine capable of improving spatial utilization of a washing tub through the enlargement of the washing tub. The dish washing machine includes a washing tub, a sump mounted in the washing tub to receive and pump wash water, a sump housing forming an external appearance of the sump, a washing impeller to pump wash water from the sump housing, a drainage channel disposed at an inner edge of the sump housing, a pump motor surrounded by the drainage pump to drive the washing impeller, and a pump motor receiving part to receive the pump motor. The pump motor receiving part protrudes above the drainage channel.

10 Claims, 9 Drawing Sheets

DISH WASHING MACHINE HAVING PUMP MOTOR AND PUMP MOTOR RECEIVING PART

CROSS-REFERENCE TO RELATED APPLICATIONS

This application claims the benefit of Korean Patent Application No. 10-2006-0065596, filed on Jul. 12, 2006 in the Korean Intellectual Property Office, the disclosure of which is incorporated herein by reference.

BACKGROUND OF THE INVENTION

1. Field of the Invention

The present invention relates to a dish washing machine. More particularly, to a dish washing machine capable of improving spatial utilization of a washing tub through the enlargement of the washing tub.

2. Description of the Related Art

A conventional dish washing machine is a machine that automatically washes dishes using cold water or hot water. A conventional dish washing machine includes a machine body, a washing tub formed in the machine body, baskets mounted in the washing tub, and main and sub nozzles mounted at the upper part, the middle part, and the lower part of the washing tub to inject wash water, which is disclosed in Korean Unexamined Patent Publication No. 2005-54700.

A sump is mounted at the bottom of the washing tub to receive wash water and pump the wash water to the respective nozzles. The sump includes a sump housing forming the external appearance of the sump, a heater mounted in the sump housing, a washing impeller disposed in the sump housing to pump wash water, a channel to guide the wash water pumped from the washing impeller to the respective nozzles, a channel control valve mounted in the channel to control the flow of wash water, and a pump motor mounted at the outside of the sump housing to drive the washing impeller.

In the conventional dish washing machine, however, the heater is mounted in the sump housing such that the height of the sump housing is increased. Furthermore, the pump motor is mounted at the bottom of the sump housing such that the height of an assembly of the sump and the pump motor is increased.

Consequently, a ratio of the height of the sump and pump motor assembly to the height of the machine body of the dish washing machine is increased, and therefore, the space of the washing tub is relatively reduced.

SUMMARY OF THE INVENTION

Accordingly, it is an aspect of the present invention to provide a dish washing machine capable of reducing the height of a sump and pump motor assembly and, at the same time, enlarging the space of a washing tub, thereby improving spatial utilization of the washing tub.

Additional aspects and/or advantages of the invention will be set forth in part in the description which follows and, in part, will be apparent from the description, or may be learned by practice of the invention.

The foregoing and/or other aspects of the present invention are achieved by providing a dish washing machine including a washing tub, a sump mounted in the washing tub to receive and pump wash water, a sump housing forming an external appearance of the sump, a washing impeller to pump wash water from the sump housing, a drainage channel disposed at an inner edge of the sump housing, a pump motor surrounded by the drainage pump to drive the washing impeller, and a pump motor receiving part to receive the pump motor, the pump motor receiving part protruding above the drainage channel.

According to an aspect of the present invention, the pump motor receiving part is formed at a bottom of the sump housing, and the pump motor receiving part includes an open lower part, through which the pump motor is inserted into and mounted to the pump motor receiving part.

The pump motor includes screw insertion holes formed in an edge thereof such that screws are inserted through the screw insertion holes, and the pump motor receiving part includes screw coupling protrusions protruding therefrom such that the screws inserted through the screw insertion holes are coupled to the screw coupling protrusions.

The dish washing machine further includes a heater disposed in a shape surrounding the sump.

The dish washing machine further includes a heater receiving groove formed at the bottom of the washing tub in a shape surrounding the sump such that the heater is received in the heater receiving groove, and a heater cover disposed at the heater receiving groove to cover the heater, the heater cover having a plurality of through-holes, through which wash water contacts the heater.

The dish washing machine further includes main nozzles disposed in the washing tub to constantly inject wash water at the time of washing dishes, a sub nozzle disposed in the washing tub to selectively inject wash water at the time of washing dishes, a main channel disposed in the sump, the main channel communicating with the main nozzles, a sub channel disposed in the sump while being separated from the main channel, the sub channel communicating with the sub nozzle, and a channel control valve disposed in the sub channel to selectively intermit the flow of wash water flowing to the sub nozzle.

The dish washing machine further includes an impeller casing to receive the washing impeller, and an impeller casing cover disposed on the impeller casing to cover the impeller casing, the impeller casing cover having a guide channel communicating with the sub channel to guide the wash water to the sub nozzle.

The impeller casing includes a filth chamber communicating with the main channel to collect dirt contained in wash water.

The filth chamber includes an open upper part, and the dish washing machine further includes a mesh filter disposed at the open upper part of the filth chamber to separate dirt from wash water such that only the wash water overflows from the filth chamber.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
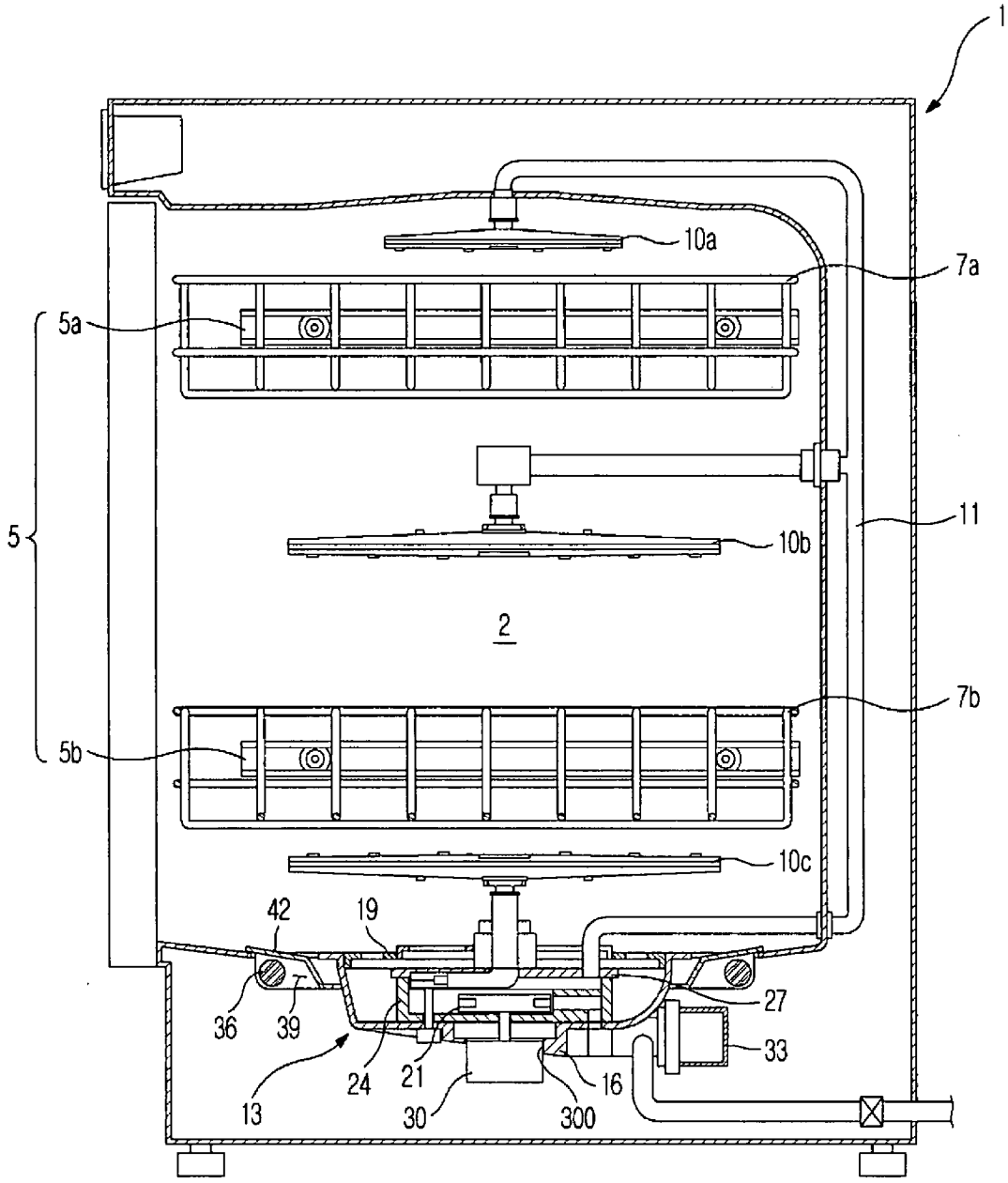
FIG. 1 is a side sectional view of a dish washing machine according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

As shown in FIG. 1, the dish washing machine comprises a machine body 1 forming an external appearance of the dish washing machine, a washing tub 2 disposed in the machine body 1, and a rack 5 fixed to a sidewall of the washing tub 2. The rack 5 comprises an upper rack 5*a* and a lower rack 5*b*, by which an upper basket 7*a* and a lower basket 7*b* are supported, respectively. Dishes are placed in the upper basket 7*a* and the lower basket 7*b*.

At the upper part, the middle part, and the lower part of the washing tub 2 are mounted main nozzles 10*a* and 10*b* and a sub nozzle 10*c*, respectively, to inject wash water. The wash water injected through the nozzles 10*a*, 10*b* and 10*c* is directed toward the baskets 7*a* and 7*b*. The nozzles 10*a*, 10*b* and 10*c* are rotated by the injection pressure of the wash water injected through the nozzles 10*a*, 10*b* and 10*c*. The wash water injected through the nozzles 10*a*, 10*b*, and 10*c* collides with the dishes in the baskets 7*a* and 7*b* to strongly wash the dishes.

A sump 13 is mounted at the bottom of the washing tub 2 to receive, pump, and supply wash water to the respective nozzles.

A feeding pipe 11 is disposed at a rear of the washing tub 2 to supply wash water to the main nozzles 10*a* and 10*b*. The lower end of the feeding pipe 11 is connected to the sump 13. Consequently, the wash water flows to the main nozzles 10*a* and 10*b* through the feeding pipe 11 due to strong pumping pressure of the sump 13.

The sub nozzle 10*c* is directly connected with an upper center part of the sump 13. Consequently, some of the wash water is injected through the sub nozzle 10*c* to wash dishes placed in the lower basket 7*b* adjacent to the sub nozzle 10*c*.

When the quantity of dishes is relatively small, the dishes may be placed only in the upper basket 7*a*, and wash water be injected only through the main nozzles 10*a* and 10*b* while the wash water is not injected through the sub nozzle 10*c*, and vice versa.

The sump 13 comprises a sump housing 16 forming the external appearance of the sump, a sump cover 19 to cover the sump housing 16, a washing impeller 21 disposed in the sump housing 16, an impeller casing 24 to which the washing impeller 21 is mounted, and an impeller casing cover 27 disposed on the impeller casing 24.

A pump motor 30 is mounted at the bottom of the sump housing 16 to drive the washing impeller 21. Specifically, a pump motor receiving part 300 is disposed at the bottom of the sump housing 16 such that the pump motor 30 is received in the pump motor receiving part 300.

The pump motor 30 is securely coupled with the sump housing 16 by means of screws. However, the present invention is not limited hereto and other coupling members may used to accomplish the coupling between the pump motor 30 and the sump housing 16.

As shown in the drawings, the lower part of the sump 13 overlaps with the upper part of the pump motor 30 by a predetermined height.

Thus, a height of an assembly of the sump 13 and the pump motor 30 is reduced by the overlap. The decrease of the height of the sump and pump motor assembly leads to the relative increase of the vertical height of the washing tub 2.

A drainage pump 33 is mounted at the side of the sump housing 16 ito discharge wash water and dirt in the sump 13 out of the dish washing machine.

A heater 36 is mounted at an edge of the sump 13 to heat wash water. At the bottom of the washing tub 2 is formed a heater receiving groove 39, which extends along the edge of the sump 13. The heater 36 is received in the heater receiving groove 39.

After the heater 36 is received in the heater receiving groove 39, the heater 36 is covered by a heater cover 42 to prevent the heater 36 from being exposed to the outside.

Figure 2:
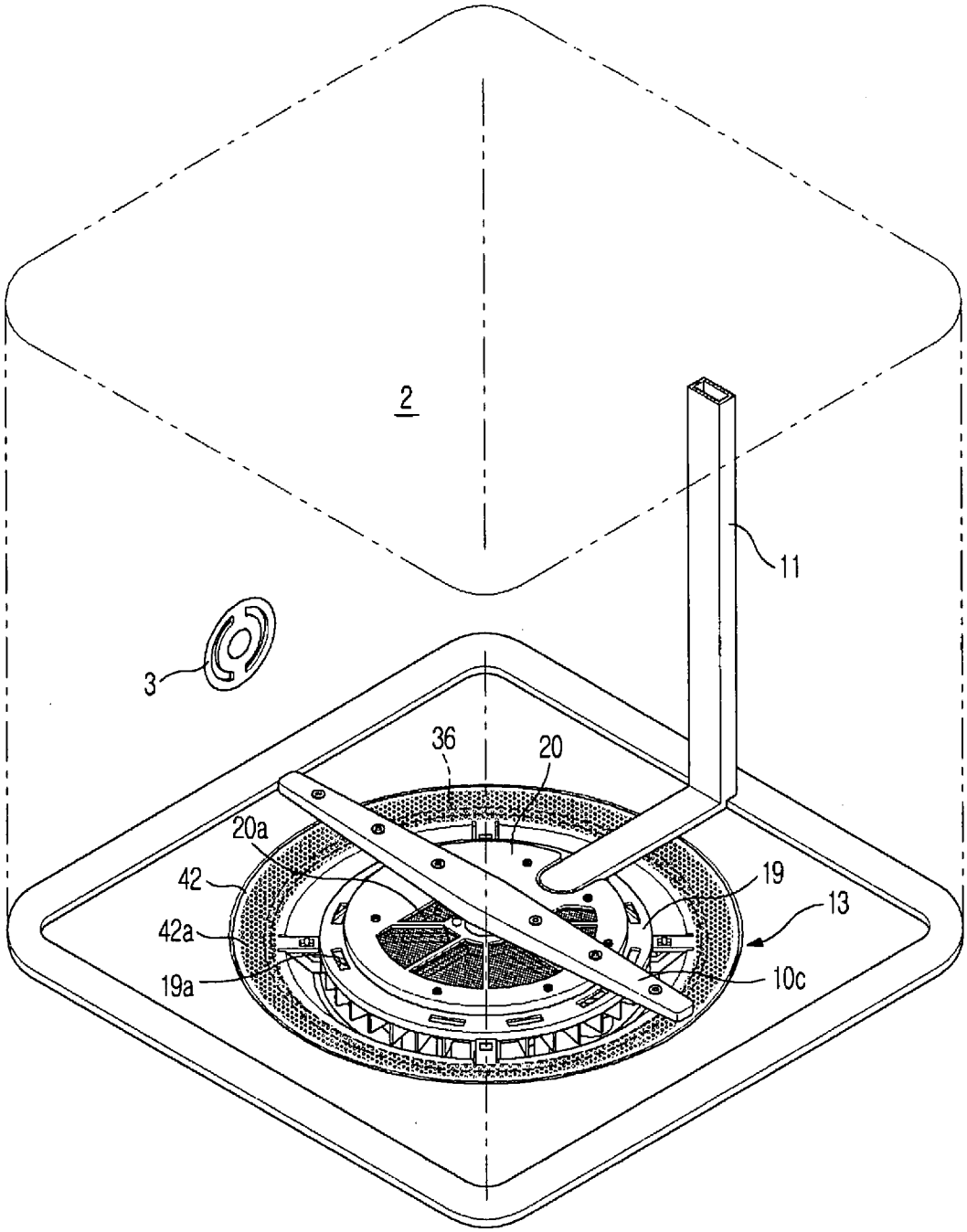
FIG. 2 is a perspective view illustrating an interior of a machine body of the dish washing machine according to an embodiment of the present invention.

In FIG. 2, an inlet port 3 is formed through one side of the washing tub 2 such that wash water can be introduced into the washing tub 2 through the inlet port 3. Wash water introduced through the inlet port 3 falls to the bottom of the washing tub 2 and is introduced into the sump 13.

The sub nozzle 10*c* is rotatably coupled to a center of the sump 13. The feeding pipe 11 is connected with a rear end of the sump 13 such that wash water is guided to the main nozzles 10*a* and 10*b* through the feeding pipe 11.

The sump cover 19 is mounted on the sump 13. Inlet holes 19*a* are formed along an edge of the sump cover 19 and are arranged in regular intervals. Consequently, wash water is introduced into the sump 13 through the inlet holes 19*a*.

On the sump cover 19 is mounted a filter cover 20. A mesh filter 20*a* is mounted to the filter cover 20 to prevent dirt collected in a filth chamber (to be described later), from overflowing from the filth chamber and to allow only wash water to flow out of the filth chamber.

The heater 36 is mounted at an edge of the sump 13 in the shape of a ring. The heater cover 42 is mounted on the heater 36. A plurality of through-holes 42*a*, through which wash water flows to the heater 36, are defined through the heater cover 42. The wash water is heated by the heater 36, and is then introduced into the sump 13.

Figure 3:
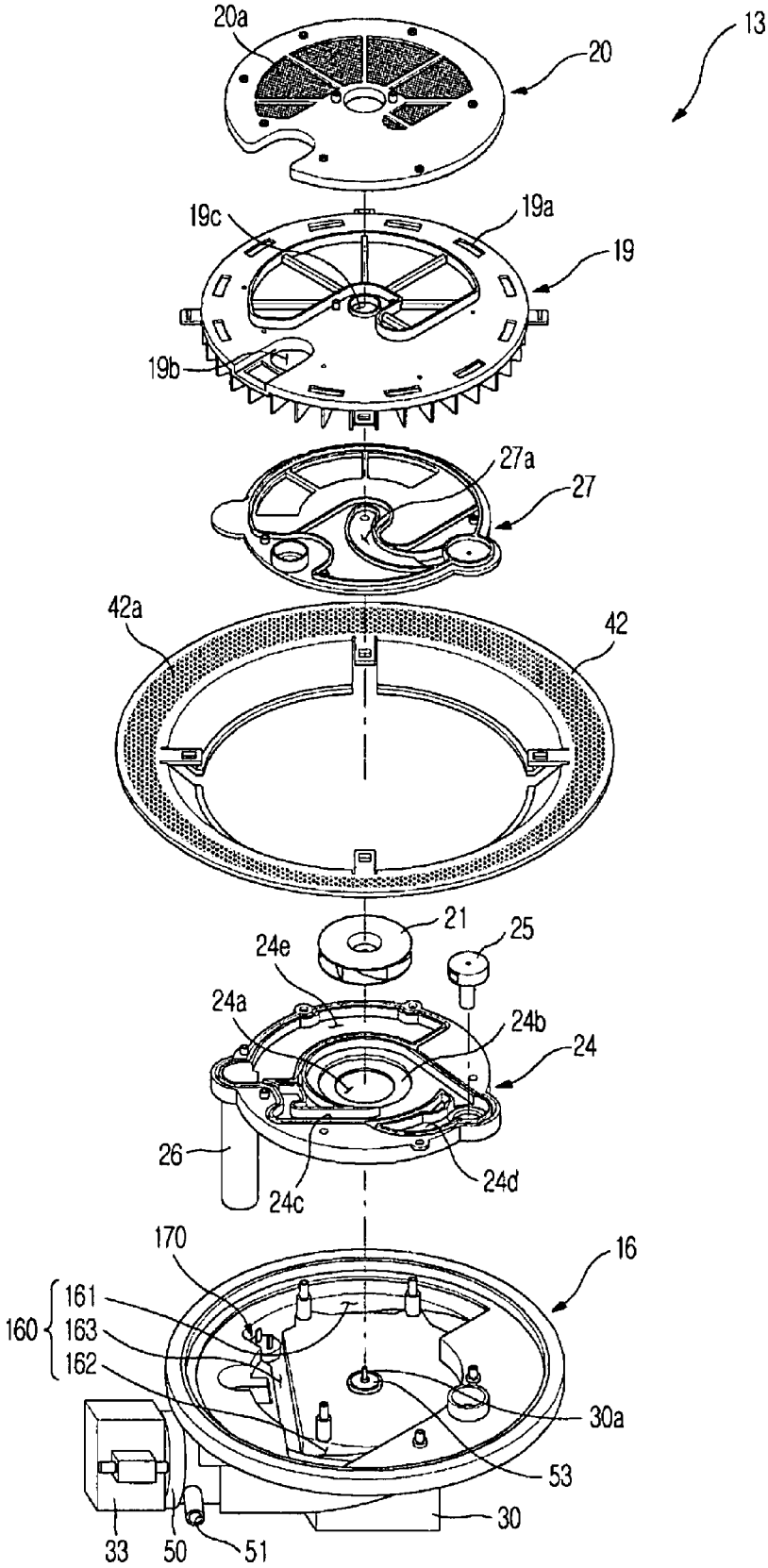
FIG. 3 is an exploded perspective view of a sump according to an embodiment of the present invention.

FIG. 3 illustrates the structure of the sump 13, according to an embodiment of the present invention. At one side of the sump housing 16 is disposed a pump fixing part 50, to which the drainage pump 33 is fixed. To one side of the pump fixing part 50 is connected a drainage pipe 51, through which wash water and filth are discharged.

The pump motor 30 is mounted at the bottom of the sump housing 16, specifically, to the pump motor receiving part 300. Around the pump motor receiving part 300 (shown in FIGS. 1 and 4, for example) is disposed a drainage channel 160, which surrounds the pump motor receiving part 300. The drainage channel 160 comprise first, second, and third drainage channels 161, 162, and 163 surrounding the pump motor receiving part 300. The first and second drainage channels 161 and 162 communicate with each other through the third drainage channel 163, which serves to guide wash water and filth to the drainage pump 33.

The top surface of the pump motor receiving part 300 is located above the bottom surface of the drainage channel 160.

Consequently, the pump motor 30 is received in the pump motor receiving part 300 without reduction of the wash water and filth discharge operation through the drainage channel 160, and therefore, the height of the sump and pump motor assembly is considerably reduced.

A rotary shaft 30*a* of the pump motor 30 extends through the pump motor receiving part 300. At the pump motor receiving part 300 is disposed a sealing member 53, which surrounds the rotary shaft 30*a* to prevent wash water from leaking to the pump motor 30.

The impeller casing 24 is disposed on the sump housing 16. A communication hole 24a is formed in a center of the impeller casing 24 and communicates with the sump housing 16. Around the communication hole 24*a* is disposed an impeller receiving part 24*b*, in which the washing impeller 21 is received.

The washing impeller 21 is coupled with the rotary shaft 30*a* of the pump motor 30 such that the washing impeller 21 is rotated to pump wash water introduced into the sump housing 16 upward.

The impeller casing 24 comprises a main channel 24*c* and a sub channel 24*d*, which diverge from the impeller receiving part 24*b*. The main channel 24*c* guides wash water to the main nozzles 10*a* and 10*b* (see FIG. 1). The sub channel 24*d* guides wash water to the sub nozzle 10*c* (see FIG. 1).

The main channel 24*c* serves as a primary channel to guide the flow of wash water in the sump 13. Consequently, wash water constantly passes along the main channel 24*c* during a washing operation of the dish washing machine.

The main channel 24*c* extends from the impeller receiving part 24*a* in a shape of a curve, to prevent drop of the injection pressure of wash water flowing along the main channel 24*c*.

When the main channel 24*c* is sharply bent, wash water collides with the sharply bent part of the main channel 24*c* with the result that kinetic energy of the wash water is lost. Consequently, the main channel 24*c* is formed in the shape of a curve to minimize the loss of kinetic energy.

A channel control valve 25 is rotatably mounted in the sub channel 24*d* to intermit the flow of wash water to the sub channel 24*d*. When the quantity of dishes to be washed is small, the sub channel 24*d* is closed by the channel control valve 25 such that wash water can flow only to the main channel 24*c*.

Wash water flowing along the main channel 24*c* is injected through the main nozzles 10*a* and 10*b* (see FIG. 1) to wash dishes. Consequently, the amount of wash water used is reduced when the quantity of dishes to be washed is small.

A filth chamber 24*e* is formed beside the main channel 24*c* to collect dirt introduced into the main channel 24*c* together with wash water. A drainage connection pipe 26 is mounted adjacent to the inlet of the filth chamber 24*e*, which is connected to the drainage pump 33. When the drainage pump 33 is operated, dirt collected in the filth chamber 24*e* is discharged to the drainage pipe 51 through the drainage connection pipe 26.

According to an embodiment of the present invention, the main channel 24*c*, the sub channel 24*d*, and the filth chamber 24*e* are formed at the impeller casing 24.

The impeller casing cover 27 is disposed on the impeller casing 24. The impeller casing cover 27 comprises a guide channel 27*a*, which communicates with the sub channel 24*d*. The guide channel 27*a* extends from an edge of the impeller casing cover 27 to the center of the impeller casing cover 27 in a shape of a curve.

Consequently, when the sub channel 24*d* is opened by the channel control valve 25, wash water pumped by the washing impeller 21 passes through the channel control valve 25, and flows along the sub channel 24*d*. At this time, the wash water is guided to the sub nozzle 10*c* (see FIG. 1) along the guide channel 27*a*, which communicates with the sub channel 24*d*, and is then injected through the sub nozzle 10*c*.

The sump cover 19 is disposed on the impeller casing cover 27. In the center of the sump cover 19 is formed an engaging hole 19*c*, in which the lower end of the sub nozzle 10*c* (see FIG. 1) is engaged. The inlet holes 19*a*, through which wash water is introduced, are formed along the edge of the sump cover 19 such that the inlet holes 19*a* are arranged in regular intervals.

In the sump cover 19 is formed a connection hole 19*b*, through which the feeding pipe 11 (see FIG. 2) extends to the main channel 24*c*.

The filter cover 20 is disposed on the sump cover 19. The mesh filter 20*a* is mounted to the filter cover 20. The mesh filter 20*a* covers an upper surface of the filth chamber 24*e* to prevent dirt collected in the filth chamber 24*e* from passing through the mesh filter 20*a* together with wash water.

Specifically, when dirt and wash water are introduced into the filth chamber 24*e*, the wash water passes through the mesh filter 20*a*. However, the dirt is filtered by the mesh filter 20*a* and is left in the filth chamber 24*e*.

The wash water separated from the dirt is introduced into the sump 13 through the inlet holes 19*a*, and is then continuously circulated through the above-described course.

The heater 36 (see FIG. 2) and the heater cover 42 are disposed at the edge of the sump 13 such that the heater 36 and the heater cover 42 surround the edge of the sump 13.

Figure 4:
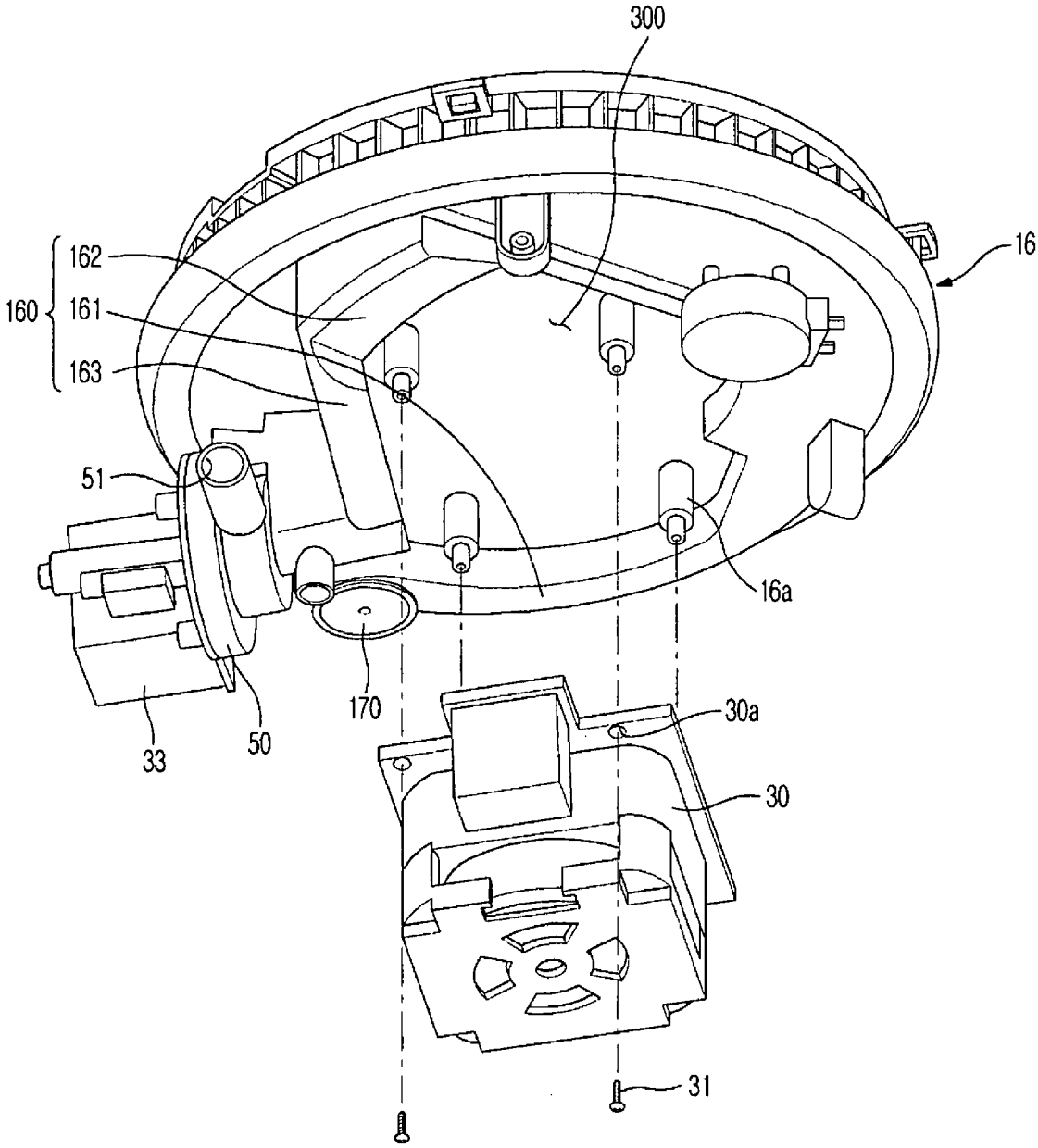
FIG. 4 is an exploded perspective view of a sump housing and a pump motor according to an embodiment of the present invention.

As shown in FIG. 4, the pump motor receiving part 300 is disposed in the center of the sump housing 16. Screw coupling protrusions 16*a* are formed at the pump motor receiving part 300 and protrude downward from the pump motor receiving part 300.

The first, second, and third drainage channels 161, 162, and 163 are formed around the pump motor receiving part 300. The drainage channel 160 is disposed below the pump motor receiving part 300.

Screw insertions holes 30*a* are formed in an edge of the pump motor 30 corresponding to the screw coupling protrusions 16*a*.

Figure 5:
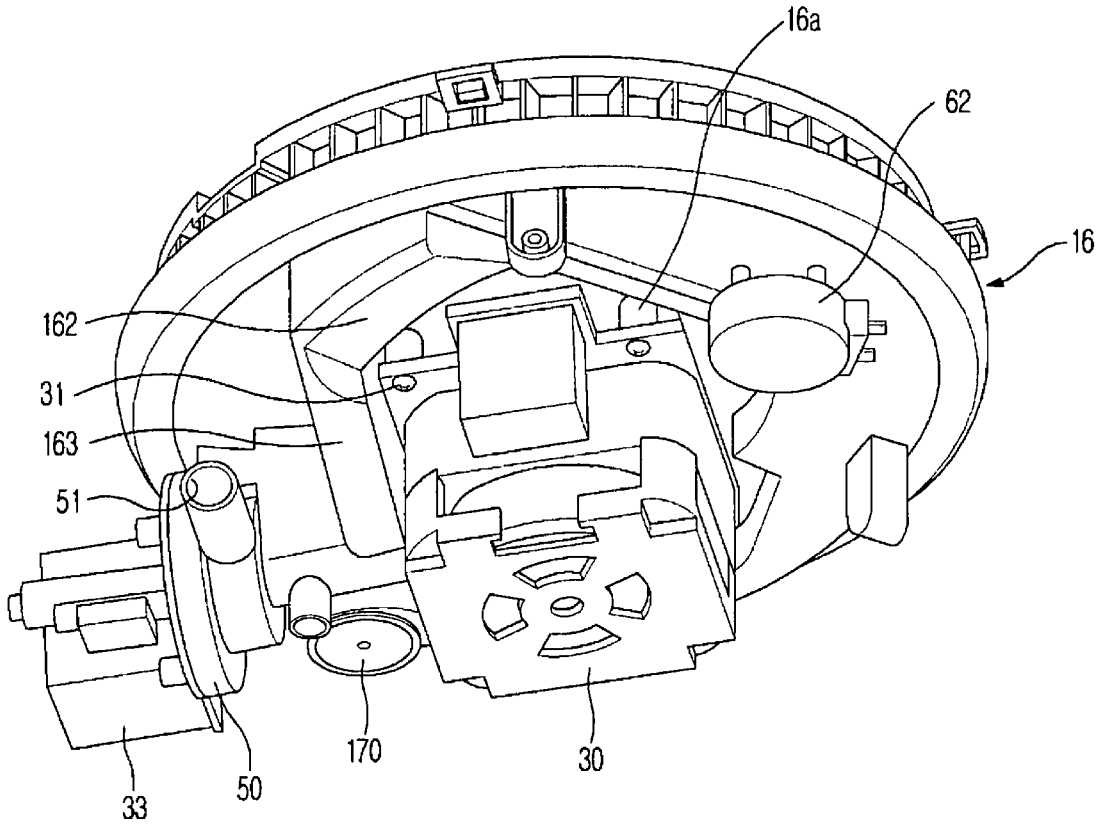
FIGS. 5 and 9 are assembled views of the sump housing and the pump motor according to an embodiment of the present invention.

When screws 31 are inserted through the screw insertion holes 30*a* and coupled with the screw coupling protrusions 16*a*, as shown in FIG. 5, the pump motor 30 is surrounded by the drainage channels 161, 162, and 163 while the pump motor 30 is received in the pump motor receiving part 300.

The pump fixing part 50 is disposed at one side of the sump housing 16. The drainage pump 33 is fixed to the pump fixing part 50. At the sump housing 16 is mounted a sensor 170 to detect the turbidity and the water level of wash water received in the sump housing 16. The drainage pump 33 discharges wash water and dirt out of the sump housing 16 based on information detected by the sensor 170.

At the bottom of the sump housing 16 is mounted a valve driving motor 62 to drive the channel control valve (not shown) such that the sub channel (not shown) can be opened or closed by the channel control valve.

Figure 6:
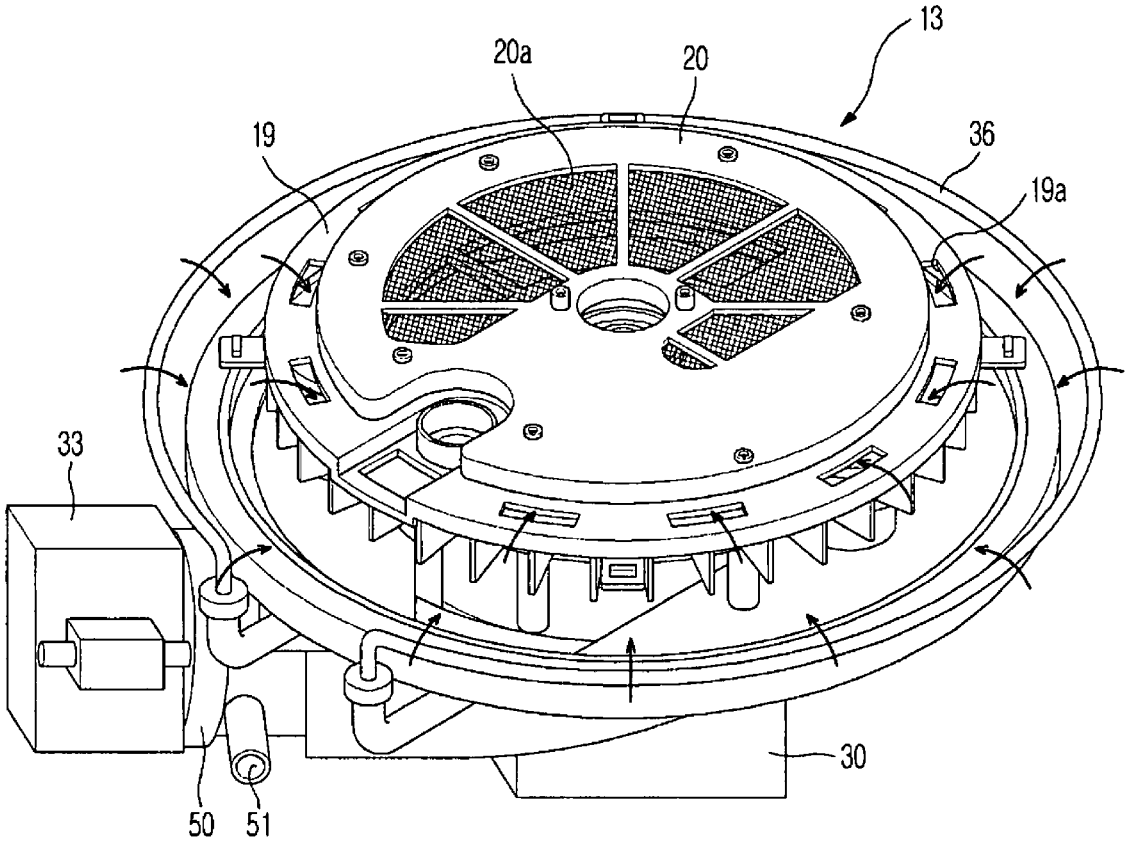
FIG. 6 is a perspective view illustrating the upper part of the sump according to an embodiment of the present invention.
Figure 7:
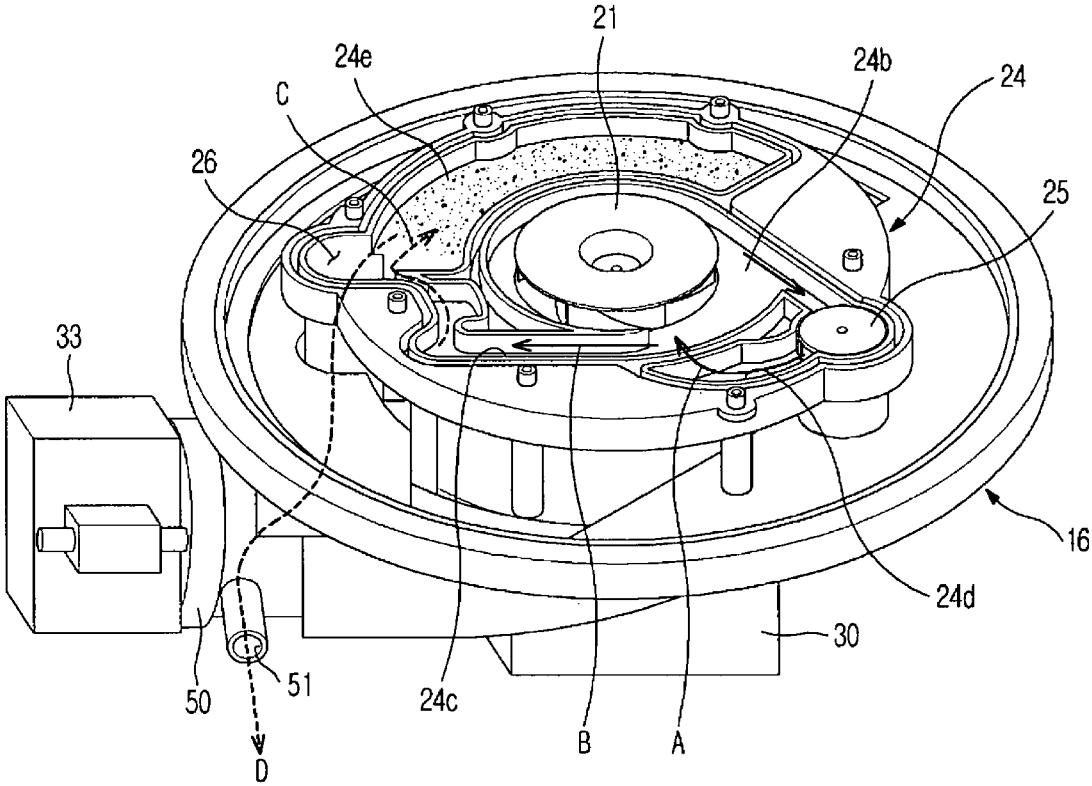
FIG. 7 is a perspective view illustrating the upper part of the sump housing according to an embodiment of the present invention.

As shown in FIG. 6, wash water is heated by the heater 36, and is then introduced into the sump 13. As shown in FIG. 7, the wash water received in the sump housing 16 is pumped upward to the impeller casing 24 as the washing impeller 21 mounted to the rotary shaft is rotated.

The pumped wash water is moved from the impeller receiving part 24*b* to the main channel 24*c* (in the direction indicated by arrow 'A') and the sub channel 24*d* (in the direction indicated by arrow 'B') due to the rotating force of the washing impeller. When the sub channel 24*d* is closed by the channel control valve 25, the wash water is moved only to the main channel 24*c*.

The wash water flowing along the main channel 24*c* in the direction indicated by arrow 'A' is raised through the feeding pipe 11 (see FIG. 2), due to the strong pressure of the washing impeller 21, and then reaches the main nozzles 10*a* and 10*b* (see FIG. 1).

When the quantity of dishes to be washed is small, and therefore, it is necessary to operate only the main nozzles 10*a* and 10*b* (see FIG. 1), the sub channel 24*d* is closed by the channel control valve 25. As a result, wash water flows along only the main channel 24*c*. The wash water flowing along the main channel 24*c* reaches the main nozzles 10*a* and 10*b* through the feeding pipe 11, and is then injected through the main nozzles 10*a* and 10*b*.

When the quantity of dishes to be washed is large, and therefore, it is necessary to operate the sub nozzle 10*c* (see FIG. 1) as well as the main nozzles 10*a* and 10*b*, the sub channel 24*d* is opened by the channel control valve 25. As a result, wash water flows in the direction indicated by arrow B. Subsequently, the wash water reaches the sub nozzle 10*c*, and is then injected through the sub nozzle 10*c*.

The filth chamber 24*e* is connected to the main channel 24*c*. Consequently, dirt mixed with some wash water is moved (in the direction indicated by arrow 'C'), and is then collected in the filth chamber 24*e*.

The drainage connection pipe 26 connected to the drainage pump 33 is adjacent to the inlet of the filth chamber 24*e*. Consequently, the dirt collected in the filth chamber 24*e* is discharged to the outside (in the direction indicated by arrow 'D') during an operation of the drainage pump 33.

Figure 8:
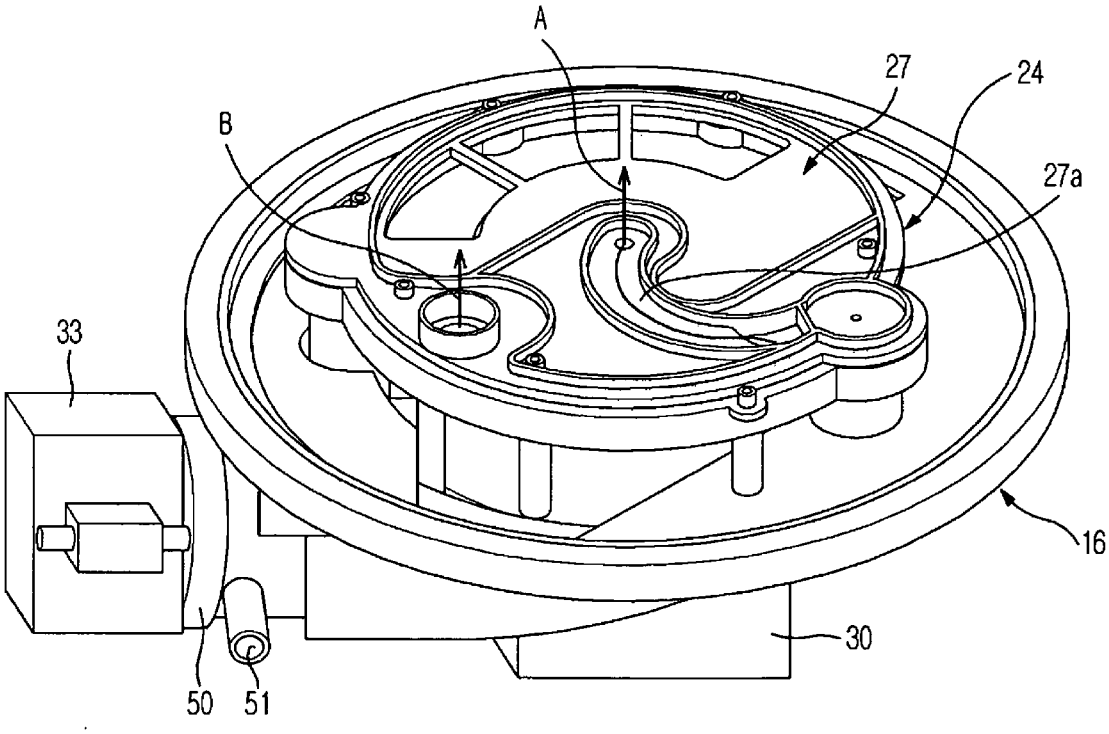
FIG. 8 is an assembled perspective view of the sump housing and an impeller casing according to an embodiment of the present invention.

As shown in FIG. 8, the guide channel 27*a* is formed at the impeller casing cover 27 disposed on the impeller casing 24 such that the guide channel 27*a* communicates with the sub channel 24*d* (see FIG. 7)

When the washing impeller 21 (see FIG. 7) is operated in the state that the sub channel 24*d* is opened by the channel control valve 25 (see FIG. 7), wash water also flows along the sub channel 24*d*. The wash water flowing along the sub channel 24*d* is guided to the center of the impeller casing cover 27 along the guide channel 27*a*, is moved to the sub nozzle 10*c* (see FIG. 1) in the direction indicated by arrow 'A', and is injected through the sub nozzle 10*c*.

Arrow 'B' indicates the flow direction of the wash water flowing to the main nozzles 10*a* and 10*b* (see FIG. 1).

Figure 9:
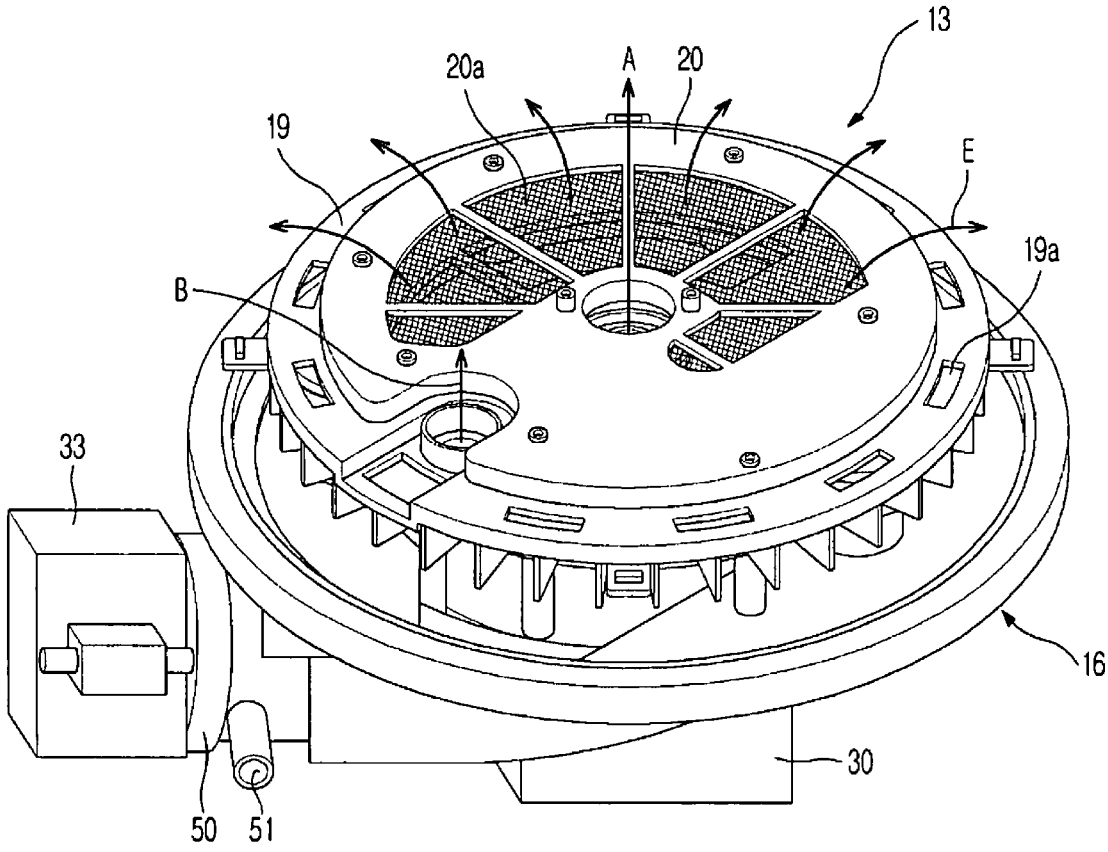

As shown in FIG. 9, wash water and dirt introduced into the filth chamber 24*e* (see FIG. 7) along the main channel 24*c* (see FIG. 7) are pushed toward the mesh filter 20*a* due to the pressure of subsequent wash water. However, the dirt does not pass through the mesh filter 20*a*. Consequently, the dirt is left in the filth chamber 24*e* (see FIG. 7). Only the wash water passes through the mesh filter 20*a* in the direction indicated by arrow 'E', and is then discharged out of the sump 13.

The discharged wash water is reintroduced into the sump 13, and flows inside the sump 13 to perform the washing operation as previously described.

As apparent from the above description, according to an embodiment of the present invention, the pump motor is mounted to the sump housing while the pump motor is received in the sump housing. Consequently, a height of the sump and pump motor assembly is reduced by the height of the pump motor received in the sump housing, and therefore, a ratio of the volume of the washing tub to the volume of the machine body is increased.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A dish washing machine comprising:

a washing tub to wash dishes therein;

a sump mounted in the washing tub to receive and pump wash water;

a sump housing forming an external appearance of the sump;

a washing impeller disposed in the sump housing to pump wash water from the sump housing;

a drainage channel disposed at an inner edge of the sump housing;

a pump motor surrounded by the drainage channel to drive the washing impeller;

a pump motor receiving part to receive the pump motor, the pump motor receiving part protruding above the drainage channel; and a heater disposed in a shape surrounding the sump, to heat the wash water, the heater being mounted at an edge of the sump in a shape of a ring.

2. The dish washing machine according to claim 1, wherein the pump motor receiving part is formed at a bottom of the sump housing, and the pump motor receiving part comprises an open lower part, through which the pump motor is inserted into and mounted to the pump motor receiving part.

3. The dish washing machine according to claim 2, wherein a lower part of the sump overlaps with an upper part of the pump motor by a predetermined height, thereby reducing a height of an assembly of the sump and the pump motor.

4. The dish washing machine according to claim 2, wherein the pump motor comprises screw insertion holes formed in an edge thereof such that screws are inserted through the screw insertion holes, and the pump motor receiving part comprises screw coupling protrusions protruding therefrom such that the screws inserted through the screw insertion holes are coupled with the screw coupling protrusions.

5. The dish washing machine according to claim 1, further comprising:

a heater receiving groove formed at the bottom of the washing tub in a shape surrounding the sump such that the heater is received in the heater receiving groove; and a heater cover disposed at the heater receiving groove to cover the heater, the heater cover comprising a plurality of through-holes, through which wash water contacts the heater.

6. The dish washing machine according to claim 1, wherein the heater cover surrounds the edge of the sump.

7. The dish washing machine according to claim 1, further comprising:

main nozzles disposed in the washing tub to constantly inject wash water when washing dishes;

a sub nozzle disposed in the washing tub to selectively inject wash water when washing dishes;

a main channel disposed in the sump, the main channel communicating with the main nozzles;

a sub channel disposed in the sump while being separated from the main channel, the sub channel communicating with the sub nozzle; and a channel control valve disposed in the sub channel to selectively intermit the flow of wash water flowing to the sub nozzle.

8. The dish washing machine according to claim 7, further comprising:

an impeller casing to receive the washing impeller; and an impeller casing cover disposed on the impeller casing to cover the impeller casing, the impeller casing cover comprising a guide channel communicating with the sub channel to guide the wash water to the sub nozzle.

9. The dish washing machine according to claim 8, wherein the impeller casing comprises a filth chamber communicating with the main channel to collect dirt contained in wash water.

10. The dish washing machine according to claim 9, wherein the filth chamber comprises an open upper part, and the dish washing machine further comprises a mesh filter disposed at the open upper part of the filth chamber to separate dirt from wash water such that only the wash water overflows from the filth chamber.

* * * * *